United States Patent [19]

Aloisi

[11] Patent Number: 5,029,749

[45] Date of Patent: Jul. 9, 1991

[54] PAPER CONTAINER AND METHOD OF MAKING THE SAME

[75] Inventor: Robert J. Aloisi, Neenah, Wis.

[73] Assignee: James River Corporation, Richmond, Va.

[21] Appl. No.: 582,770

[22] Filed: Sep. 14, 1990

[51] Int. Cl.[5] ..... B65D 3/28

[52] U.S. Cl. ..... 229/1.5 B; 229/4.5; 493/106; 493/108; 493/152; 493/158

[58] Field of Search ..... 229/1.5 B, 4.5; 493/106–109, 152, 158

[56] References Cited

U.S. PATENT DOCUMENTS

| | | | |
|---|---|---|---|
| 2,266,948 | 12/1941 | Barbieri | 493/158 |
| 2,272,920 | 2/1942 | Merta | 229/1.5 B |
| 2,288,896 | 7/1942 | Fink . | |
| 2,473,836 | 6/1949 | Wixon et al. . | |
| 2,473,840 | 6/1949 | Amberg . | |
| 2,755,983 | 7/1956 | Ringler | 229/4.5 |
| 3,065,677 | 11/1962 | Loeser . | |
| 3,182,882 | 5/1965 | Aellen, Jr. et al. | 229/4.5 |
| 3,487,443 | 12/1969 | Wise et al. | 229/1.5 B |

FOREIGN PATENT DOCUMENTS

| | | | |
|---|---|---|---|
| 8606045 | 10/1986 | PCT Int'l Appl. | 229/1.5 B |
| 958388 | 5/1964 | United Kingdom | 229/1.5 B |

*Primary Examiner*—Gary E. Elkins

*Attorney, Agent, or Firm*—Sixbey, Friedman, Leedom & Ferguson

[57] ABSTRACT

A container formed of paper material is disclosed including a substantially cylindrical body having an upper, a lower, a bottom integrally formed with the cylindrical body and closing the lower end, and a brim integrally formed on the upper end of the cylindrical body, the paper material being oriented such that the machine direction of the paper material is aligned with the circumferential direction of the container. The container being formed by providing a paper blank having a machine direction and a cross machine direction, forming the paper blank into a substantially cylindrical body having first and second open ends with the machine direction of the paper blank being aligned substantially with the circumferential direction of the body, closing one of the open ends to form a bottom of the container and forming a brim about the other of the open ends.

18 Claims, 4 Drawing Sheets

PAPER CONTAINER AND METHOD OF MAKING THE SAME

TECHNICAL FIELD

The present invention relates to the manufacture of paper containers such as paper cups, and more particularly to the manufacturing of paper containers having a brim formed about the upper periphery of the container and the machine direction of the paper stock material extending in the circumferential direction of the container.

BACKGROUND OF THE INVENTION

An ever-present concern in the manufacture of paper containers is to provide a rigid container which is capable of holding a substantial amount of fluid without collapsing when grasped by the consumer. It is also a major concern that such rigid containers be manufactured in an economical manner.

Paper container rigidity is defined by that load which when applied to the sidewalls of the container deflects the sidewall of the container inwardly one quarter of an inch. Further, this test is carried out at a point on the sidewall of the container which is two-thirds the height of the overall container. In defining the rigidity of a particular container, both dry as well as wet measurements are to be taken. Dry rigidity is measured using an empty container while wet rigidity measurements are taken at a predetermined time period, such as ten minutes after the cup has been filled with water. This rigidity test determines the ability of the container to be picked up by the consumer without collapsing inwardly and spilling the contents when the container is grasped on the sidewall.

The rigidity of a particular container is effected by the tensile and bending stiffness in both the vertical and circumferential directions of the container. One expedient for increasing the rigidity of a paper container is to form a brim about the top of the containers. As is disclosed in U.S. Pat. No. 2,473,836 issued to Vixen et al., conventional brim curling mechanism utilize complimentary curved dies in which the lower die is first moved upwardly around the upper end of the cup and to the top edge of the cup where it firmly holds the cup top against an upper die. The upper die is then moved downwardly to engage the uppermost edge of the cup between the dies with both of the dies then moving downwardly together to curl the upper edge of the container thereby forming a brim. This brim adds significantly to the rigidity of the overall cup structure.

Similarly, U.S. Pat. No. 3,065,677 issued to Loeser discloses a brim curling mechanism for containers. A lower die having a curve forming upper surface is maintained stationary while an upper die having a curve forming lower surface descends downwardly toward the stationary lower die, deflecting the upper edge portion of the cup secured by the lower die and again forming a brim about the upper periphery of the container. This brim, as stated previously, adds significantly to the overall rigidity of the container.

As is illustrated in FIG. 1A, each of the above-mentioned containers are formed with the machine direction of the paper material aligned in the axial direction of the container and the cross-machine direction of the paper material aligned in the circumferential direction of the container as shown by the arrows $MD_1$ and $CD_1$, respectively. Paper, when formed using conventional paper manufacturing processes has what is known in the art as a machine direction and a cross-machine direction. The machine direction of paper is generally that axis of the paper along which the paper moved as it was being formed. The cross-machine direction is perpendicular to the machine direction of the paper and has approximately twice the maximum stretch as that of the machine direction, while the tensile and bending stiffness of the board in the machine direction is greater than that in the cross-machine direction. Therefore, in order to easily form brims 4 about the upper periphery of the cup or container 2, the paper blank used in forming the cup 2 would be positioned as illustrated in FIG. 1A.

While the above-mentioned conventional paper containers are of the type having the machine direction of the paper material aligned with the vertical or axial direction of the resultant container, U.S. Pat. No. 2,473,840 issued to Amberg illustrates a paper container in the form of a conical paper cup being manufactured from a blank which is cut from a paper strip having a machine direction and a cross-machine direction. Accordingly, when the conical paper cup is formed, only a limited portion of the upper periphery of the conical paper cup will have the machine direction of the paper blank extending about the circumference of the cup. Additionally, a limited portion of the cross-machine direction of the paper blank extending in the circumferential direction of the conical paper cup will exist with the remaining and substantial portion of the upper periphery being somewhere between the machine direction and the cross-machine direction of the paper blank. Consequently, a brim or bead may be formed about the upper periphery of the conical paper cup using conventional die presses because the overall stretch of the paper about the upper periphery of the conical cup is greater than that of a cup having the entire upper periphery of the cup aligned substantially in the machine direction of the paper blank. Moreover, the rigidity of a conical cup formed in accordance with U.S. Pat. No. 2,473,840 will vary depending upon the particular point at which a rigidity test is applied. Therefore, the tensile and bending stiffness of the conical cup will vary significantly about the perimeter resulting in a non-uniform construction.

As is illustrated in U.S. Pat. No. 2,288,896 issued to Fink, containers having the machine direction of the paper material extending in the circumferential direction of the container have been manufactured. However, such containers are formed from a plurality of laminated layers and include metallic end closures. Containers formed in the above-mentioned manner are to be used for containing objects, such as blueprints, and, therefore, the significant drawbacks in forming brims or beads about an upper periphery of such containers is not of concern during the above-mentioned manufacturing process because such containers are not for the consumption of liquids by consumers.

In view of the foregoing, there is clearly a need for a container and more specifically a drinking cup formed of a paper material which exhibits a high degree of rigidity while having a brim or bead formed about an upper periphery thereof in order to add to the rigidity of the cup and to protect the consumer when the liquid contents of the cup are consumed.

SUMMARY OF THE INVENTION

It is a primary object of the present invention to overcome the shortcomings associated with the containers discussed above.

Another object of the present invention is to provide a container having a brim formed about the upper periphery of the container which is more resistant to collapse when grasped by the consumer than conventionally formed containers in that it has been determined that the container rigidity is more strongly dependent on the stiffness of the paper sidewall about its circumference. This being achieved by reorienting the paper material such that the machine direction of the paper material is aligned in the circumferential direction of the cup when formed in accordance with the present invention.

Another object of the present invention is to provide a brim about the upper periphery of a container having the machine direction of the paper material from which the container is formed aligned in the circumferential direction of the container without presenting vertical cracks in the brim. The brims are formed about the upper periphery of the container; however, the width of such brims is limited such that the maximum stretch of the board in the machine direction which is aligned with the circumferential direction of the cup is not exceeded.

Yet another object of the present invention is to provide a brim about the upper periphery of a container having the machine direction of the paper material from which the container is formed aligned in the circumferential direction of the container with such brim retaining a specified amount of paper material. The brim thickness may therefore be readily varied in order to retain as much paper material within the brim as is retained within wider brims of conventional containers.

These as well as other objects of the present invention are achieved by manufacturing a paper container in accordance with the present invention. That is, by providing a paper blank having a machine direction and a cross direction, forming the paper blank into a substantially cylindrical body having first and second open ends with the machine direction of the paper blank aligned substantially in the circumferential direction of the body, closing one of the open ends to form a bottom of the container and forming a brim about the other of the ends. In the preferred embodiment, the brim width is at least five times that of the caliper of the paper material and not more than a product of the radius of curvature of the container at the brim and twice the uniaxial elongation of the paper material in the machine direction as measured under the conditions experienced during production, e.g. for a container having a radius of curvature at the brim of 1.5 inches and formed of a paper blank having a caliper of 0.01 inches, and a uniaxial elongation of 2.5 percent, the brim width would be at least 0.05 inches and no greater than 0.075 inches. The above parameters result in an optimum container; however, variations from such values would result in an improved container exhibiting increased rigidity when compared to conventional containers.

These as well as additional advantages will become apparent from the following Detailed Description of the Preferred Embodiment and the several figures.

DETAILED DESCRIPTION OF THE PREFERRED EMBODIMENT

With reference now being made to the several figures, a preferred embodiment of the invention will now be described in greater detail. Throughout this specification, reference will be made to "paper" material which is to be taken in its broad sense to mean paper stock material including paperboard and other fibrous material including natural and synthetic fibers wherein machine direction versus cross-machine direction characteristics are created during the formation process. As can be seen from FIG. 1A and as previously set forth, conventional paper containers or cups 2 are manufactured with the machine direction of the paper blank being aligned in the vertical or axial direction of the cup as designated by arrow $MD_1$ and the cross-machine direction of the paper blank is aligned in the circumferential direction of the formed cup as illustrated by arrow $CD_1$. Because the cross-machine direction of the paper material exhibits a maximum stretch of approximately twice that of the machine direction, a bead or brim 4 can be readily formed about the upper periphery of the cup 2 while avoiding the formation of vertical cracks about the brim 4.

Figure 1B:
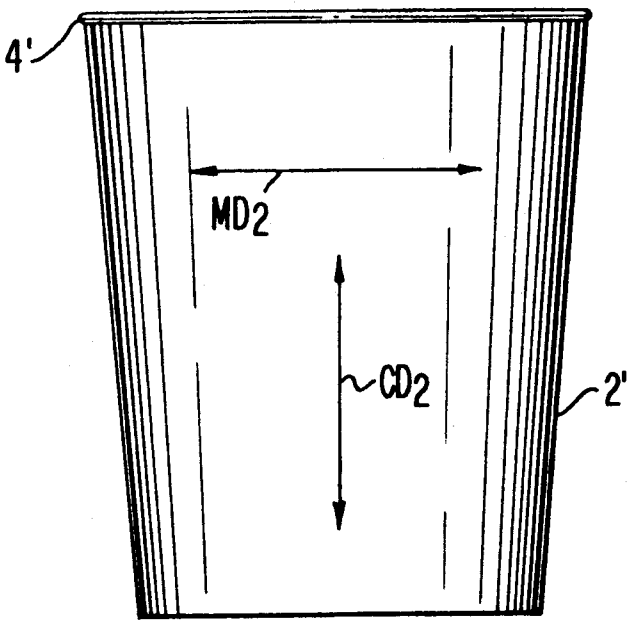
FIG. 1B is an elevational view of a container illustrating the paper orientation of a container formed in accordance with the present invention.
Figure 1A:
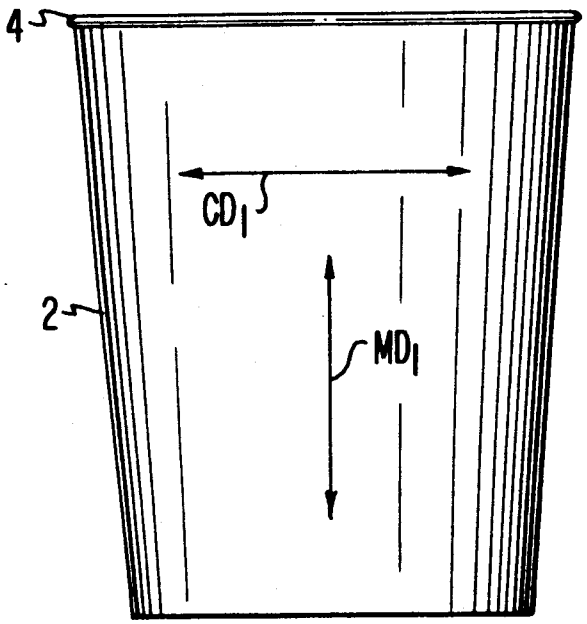
FIG. 1A (PRIOR ART)
FIG. 1A is an elevational view of a container illustrating the paper orientation of a conventional container.

A paper container or cup 2' formed in accordance with the present invention is illustrated in FIG. 1B. The cup 2' is formed of a paper blank having its machine direction aligned in the circumferential direction of the cup 2' as illustrated by arrow $MD_2$ and the cross-machine direction of the paper blank aligned in the vertical or axial direction of the cup 2' as illustrated by arrow $CD_2$. By re-orienting the paper blank, cups 2' illustrated in FIG. 1B exhibit a greater rigidity against deformation when grasped by the consumer as compared to conventional paper cups 2 in that it has been determined that the container rigidity is more strongly dependent on the stiffness of the paper sidewall about its circumference. A brim 4' is also formed about an upper periphery of the cup 2' in order to enhance even further the rigidity of the paper cup formed from the re-oriented paper blank as well as to protect the consumer when the contents of the cup are consumed. However, it is this brim 4' which if formed by conventional brim forming dies exhibit numerous vertical cracks about the periphery of the brim 4.

Figure 2A:
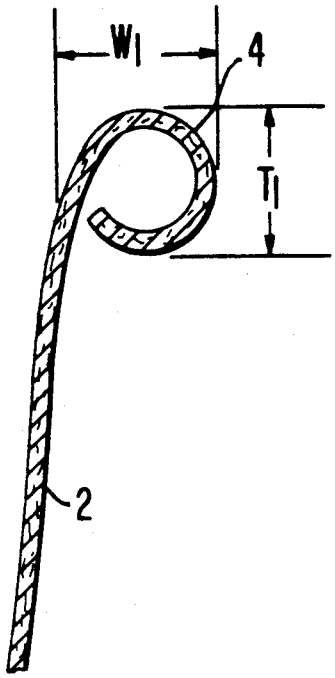
FIG. 2A (PRIOR ART)
FIG. 2A is a cross-sectional view of a brim formed about the upper periphery of the container illustrated in FIG. 1A.
Figure 2B:
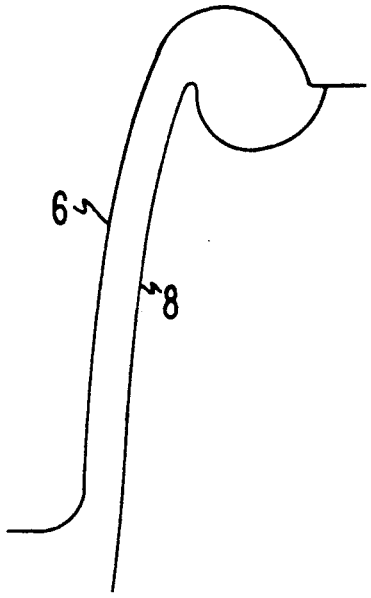
FIG. 2B (PRIOR ART)
FIG. 2B is a schematic representation of conventional cooperating tool dies for forming the brim of FIG. 2A.
Figure 3A:
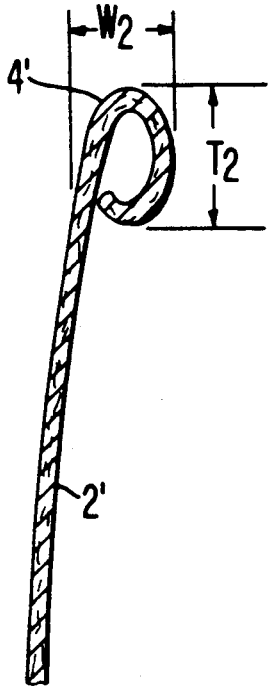
FIG. 3A is a cross-sectional view of a brim formed about the upper periphery of the container illustrated in FIG. 1B.
Figure 3B:
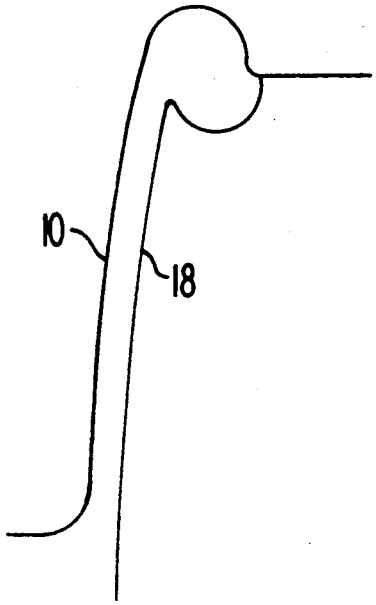
FIG. 3B is a schematic representation of cooperating tool dies for forming the brim of FIG. 3A.

Referring now to FIGS. 2A, 2B, 3A and 3B, the particular formation of the brims 4 and 4' will be described in greater detail. FIG. 2A illustrates the brim 4 formed about the upper periphery of a conventional cup 2 which is formed by the upper die 6 and lower die 8 which are illustrated in FIG. 2B. The upper die 6 may be referred to as an iron while the lower die 8 may be referred to as an insert. The brim 4 exhibits a width $W_1$ and a thickness $T_1$ which as illustrated in FIG. 2A are essentially equal. Referring now to FIG. 3A, a brim 4' formed in accordance with the present invention is illustrated. This brim 4' is formed by the cooperating die members 10 and 18 as illustrated in FIG. 3B, the particular structure of which will be described in greater detail herein below.

As noted above, because the paper material is reoriented in a manner such that the machine direction of the paper material is aligned in the circumferential direction of the cup 2', a smaller brim size due to the lower stretch in the machine direction is required.

The maximum circumferential stretch experienced by conventional cups before cracks become visible in the cup brim depends upon the specific geometry of the cup, but is normally not greater than twice the uniaxial tensile elongation at failure measured in the direction of the strain for a planar sheet of paper stock material.

Figure 4:
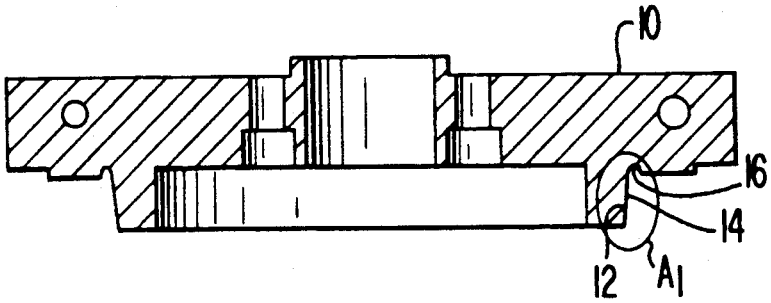
FIG. 4 is a cross-sectional view of an upper tool die for forming the brim of FIG. 3A.
Figure 5:
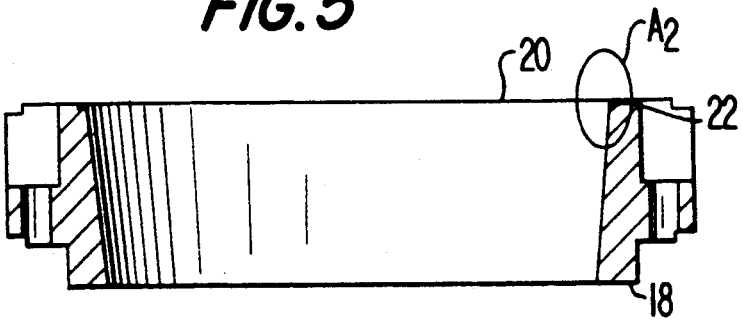
FIG. 5 is a cross-sectional view of a lower tool die for forming the brim of FIG. 3A.

Turning now to FIGS. 4 and 5, the particular die arrangement for forming the brim 4' about the upper periphery of a cup in accordance with the present invention is illustrated. Specifically, FIG. 4 illustrates the upper or male die 10 which may be manipulated by conventional brim forming devices such as those illustrated in U.S. Pat. Nos. 2,473,836 and 3,065,677 discussed above. The upper die 10 includes a lower surface having a flange 12 extending axially therefrom thereby providing a slanted outer surface 14 and an undercut 16, the significance of which will be described in greater detail hereinbelow.

The lower or female die 18 illustrated in FIG. 5 includes an axial bore 20 which receives a cup shell formed from paper material having the machine direction oriented in the circumferential direction of the cup shell with the bore 20 having an upper diameter corresponding to the diameter of the cup shell at the point where the brim 4' is to be formed, and a lower diameter which corresponds to an adjacent portion of the cup shell in order to secure the cup shell in position during the formation of the brim 4'. This lower diameter will be less than that of the upper diameter when forming brims on cups which taper from top to bottom. Also, formed about the upper periphery of the bore 20 is a channel 22 which receives paper material during the formation of the brim 4', the significance of which will be discussed in greater detail hereinbelow.

Figure 6:
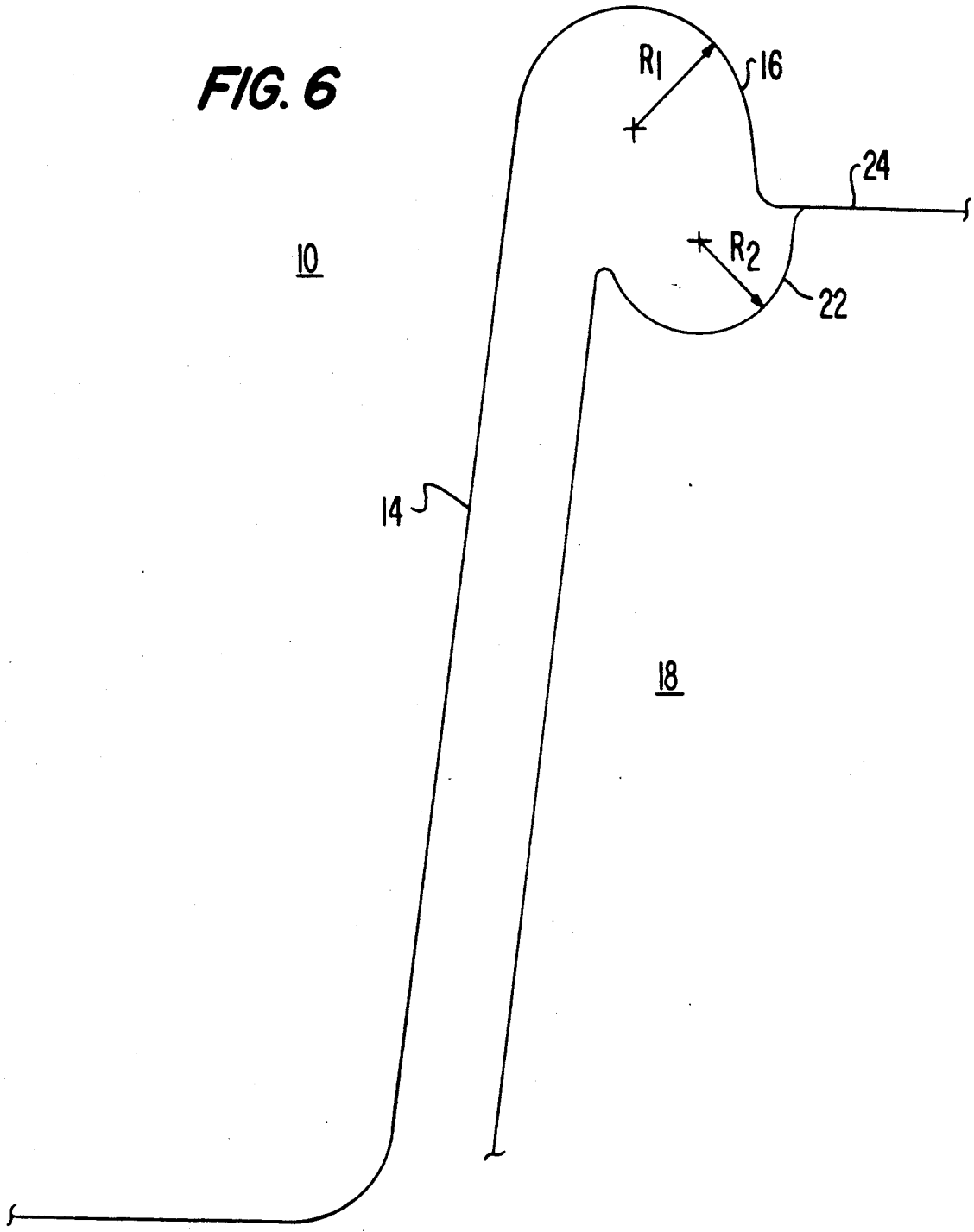
FIG. 6 is a detailed schematic representation of the cooperating tool dies for forming the brim in accordance with the present invention.

FIG. 6 illustrates those portions $A_1$ of FIG. 4 and $A_2$ of FIG. 5 in cooperation with one another in order to form the brim 4' on a 16-ounce cup shell having the machine direction of the paper material aligned in the circumferential direction of the cup. The radius of curvature $R_1$ of the undercut 16 formed in the lower surface of the die 10 for a 16-ounce cup would be approximately 0.0375 inches while the radius of curvature $R_2$ of the recess 22 formed in the upper surface of the die 18 would be equal to approximately 0.0290 inches with the central points of the radius of curvature for each of undercut 16 and recess 22 being offset from the point of contact 24 between the upper die 10 and the lower die 18. The thickness $T_2$ of the brim 4' is not dependent upon the circumferential stretch of the paper material used and, consequently, the amount at which the radius of curvatures $R_1$ and $R_2$ are offset from the point of contact 24 will depend upon the particular type of cup being manufactured, and the amount of paper material which is to be used in forming the brim 4'. While a specific example of the radius of curvatures of the undercut 16 of the upper die 10 and the recess 22 of the lower die 18 have been set forth above, in the preferred embodiment, the brim width $W_2$ of the brim 4' would be at least five times the caliper of the paper material and not more than a product of the radius of curvature of the container at the brim and twice the uniaxial elongation of the paper material in the machine direction as measured under the conditions experienced during production. It should also be noted that while the above description has been directed to paper containers and specifically cups having a circular cross section, containers having an oval, elliptical or oblong configuration would also be capable of being formed having the machine direction of the paper material extending in the circumferential direction of the container with the brim being conformed to meet the above-mentioned criteria. Also, the above would apply to uncoated containers as well as coated containers, i.e., paper coated with polyethylene, wax, or other known coatings.

The following is a summary of tests which have been conducted in order to confirm the above discussion. For the comparisons set forth, 16 oz. cup shells were chosen with half of the sample cup shells having the machine direction of the paper material extending in the vertical or axial direction of the cup and half of the sample cup shells were formed having the machine direction of the paper material extending in the circumferential direction of the cup. A brim was formed about the upper periphery of each of the cups having the machine direction aligned in the axial or vertical direction of the cup by way of conventional brim forming dies while a brim was formed about the upper periphery of each of the cups having the machine direction oriented in the circumferential direction of the cup by dies in accordance with the present invention. A rigidity test was conducted on each of the cups by applying a load at a point two-thirds the height of the overall container of the side walls of the container in order to deflect the side walls of the cup inwardly one quarter of an inch. The results of such tests are set forth hereinbelow in Table I.

TABLE I

| | Estimated Dry Cup Rigidity (lbs./.25") | |
|---|---|---|
| Sample | MD-Vertical | MD-Circumferential |
| 1 | 0.712 | 0.814 |
| 2 | 0.712 | 0.792 |
| 3 | 0.696 | 0.789 |
| Ave. | 0.707 | 0.798 |
| Std. Dev. | 0.006 | 0.009 |

As can be seen from the foregoing, the average rigidity was 0.092 lbs. per 0.25 inches greater for cups having the machine direction of the paper material oriented in the circumferential direction of the cup than that of conventional paper cups. Or in the other words, the rigidity of the paper cups formed in accordance with the present invention were thirteen per cent greater than that of conventional paper cups.

In order to reach the above summarized determinations, tests were run on four sets of paper cups, with two sets having the machine direction of the paper material oriented in the vertical or axial direction of the cup with one set having the brim formed with conventional brim forming dies and one set having the brims formed with the dies set forth in accordance with the present invention. Also, two sets of cup blanks were formed with the machine direction of the paper material oriented in the circumferential direction of the cup, with one set having brims formed thereon by conventional dies and the other set having brims formed by the dies set forth in accordance with the present invention. Twenty cups were formed with each set including five samples. These cups being set forth in Table II. The paper properties of the paper used for all twenty cups is set forth below.

TABLE II

| | BOARD PROPERTIES | | |
|---|---|---|---|
| Cup # | Tool Temp (°F.) | Orientation | Die |
| 1 | 180–185 | MD - Circ. | Experimental |
| 2 | 180–185 | MD - Circ. | Experimental |
| 3 | 180–185 | MD - Circ. | Experimental |
| 4 | 175–180 | MD - Vert. | Production |
| 5 | 175–180 | MD - Vert. | Production |
| 6 | 175–180 | MD - Vert. | Production |
| 7 | 180 | MD - Circ. | Production |
| 8 | 180 | MD - Circ. | Production |
| 9 | 180 | MD - Circ. | Production |
| 10 | 190–195 | MD - Vert. | Experimental |
| 11 | 190–195 | MD - Vert. | Experimental |
| 12 | 190–195 | MD - Vert. | Experimental |
| 13 | 190–195 | MD - Circ. | Experimental |
| 14 | 190–195 | MD - Circ. | Experimental |
| 15 | 175–180 | MD - Vert. | Production |
| 16 | 175–180 | MD - Vert. | Production |
| 17 | 175–180 | MD - Circ. | Production |
| 18 | 175–180 | MD - Circ. | Production |
| 19 | 185–190 | MD - Vert. | Experimental |
| 20 | 185–190 | MD - Vert. | Experimental |

Weight = 156 lb/ream
Caliper = 13.8 mil
Stretch (MD) = 2.4%
Stretch (CD) = 5.0%

Brims were successfully formed on all five samples (cup Nos. 1, 2, 3, 13 and 14) in which the tooling die in accordance with the present invention were used and the machine direction of the paper material was oriented in the circumferential direction of the container. Also, major cracking was observed in all instances (cup Nos. 7, 8, 9, 17 and 18) where the machine direction of the paper material was aligned in the circumferential direction of the container and conventional or production dies were used to form the brims about the upper periphery of the container.

The rigidity of these cups was then estimated by placing a metal disk in the bottom of the container shell to approximate the effect of a formed bottom on the cup rigidity. Three cups were then selected from each set because two of the samples (cup Nos. 6 and 16) were destroyed when they jammed in the production tooling set. Further, no measurements were taken on the containers which evidenced major cracking about the perimeter of the brim. The results of this rigidity test being set forth in Table III below.

TABLE III

| SET | CUP # | RIGIDITY | AVE. (STD. DEV.) |
|---|---|---|---|
| Production Tool | 4 | 0.712 | 0.707 (.006) |
| MD-Vertical | 5 | 0.712 | |
| | 15 | 0.696 | |
| Experimental Tool | 1 | 0.814 | 0.798 (.009) |
| MD-Circumferential | 3 | 0.792 | |
| | 14 | 0.789 | |
| Experimental Tool | 10 | 0.643 | 0.637 (.004) |
| MD-Vertical | 12 | 0.635 | |
| | 19 | 0.632 | |

Again, from the above rigidity measurements, the average rigidity was 0.092 lbs per 0.25 inches greater for cups having the machine direction of the paper material oriented in the circumferential direction of a cup than that of conventional paper cups. This results in an overall increase in rigidity which is approximately thirteen percent greater than was previously evidenced by conventional paper cups. In the preferred embodiment, the brim width is at least five times that of the caliper of the paper material and not more than a product of the radius of curvature of the container at the brim and twice the uniaxial elongation of the paper material in the machine direction as measured under the conditions experienced during production, e.g. for a container having a radius of curvature at the brim of 1.5 inches and formed of a paper blank having a caliper of 0.01 inches, and a uniaxial elongation of 2.5. percent, the brim width would be at least 0.05 inches and no greater than 0.075 inches. The above parameters result in an optimum container; however, variations from such values would result in an improved container exhibiting increased rigidity when compared to conventional containers.

The method of manufacturing the brim 4' on paper cup shells 2' will now be set forth in greater detail. Initially, a paper blank is cut from either a sheet or roll of paper material in such a manner that the machine direction of the paper material extends in what will be the circumferential direction of a cup formed from the paper blank. The blank is then formed into a cup shell and sealed along the vertical seam formed by the overlapping of the ends of the paper blank. A bottom is then placed within the lower region of the cup shell and the lower periphery of the cup shell is folded inwardly in order to maintain the bottom of the cup in its predetermined position. It should be noted that due to the higher degree of stretch in the cross direction of the paper material, a lesser force will be required to form the bottom fold on the cup because the cross direction of the paper material is now aligned with the axial or vertical direction of the paper cup. This will also result in a much improved seal on the bottom of the cup. Once the bottom of the cup has been secured in place, the cup shell is positioned within the bore 20 of the lower die 18 and positioned below the upper die 10. Once in this position, the upper die will descend downwardly toward the stationary lower die 18 to the position shown in FIG. 6 where the upper surface of the lower die contacts a lower surface of the upper die.

As the upper die 10 descends, the leading edge of the cup shell will engage the surface 14 of the flange 12 and the undercut 16, thereby forcing the leading edge of the cup shell outwardly and downwardly along the radius of curvature R1. During the continued downward movement of the upper die 10, the leading edge of the cup shell will then engage the recess 22 formed in the lower die 18 which will deflect the leading edge of the cup shell inwardly and then upwardly into contact with the outer surface of the cup shell. Upon completion of the die stroke, the brim will then be completely formed and when the upper die is withdrawn from the lower die, the brim formed about the upper periphery of the cup shell will not be disturbed. The completely formed cup will then remain in the lower die and moved to the next manufacturing station. It should be noted that during this manufacturing process, both the upper and lower dies may be heated in order to more readily shape the brim 4' about the upper periphery of the cup shell. Also, prior to the formation of the brim by the cooperation of the upper die 10 and lower die 18, a precurl may be performed on the upper periphery of the cup shell which can be performed at a station prior to the final formation of the brim.

While the present invention has been described with reference to a preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

INDUSTRIAL APPLICABILITY

Containers formed in accordance with the foregoing description may be manufactured by existing manufacturing assemblies with only minor changes being made to the orientation in which the paper blanks are received by the manufacturing assembly and the sizing and shape of the upper and lower dies used to form the brims about the upper periphery of the container. Again, it is to be noted that the above description is not solely limited to paper cups but may be applied to paper containers having an oval, oblong or elliptical cross section.

I claim:

1. A method of making a paper container comprising the steps of:

a) providing a paper blank having a machine direction and a cross-machine direction;

b) forming said paper blank into a substantially cylindrical body having first and second open ends with said machine direction of said paper blank aligned substantially with a circumferential direction of said body;

c) closing one of said open ends to form a bottom of said container; and d) forming a brim about the other of said open ends.

2. The method as defined in claim 1, wherein the step of forming a brim about the other of said open ends includes; positioning said cylindrical body in a central bore of a lower die having a recess formed in an upper surface of said lower die with a portion of said cylindrical body extending above said upper surface of said lower die and lowering an upper die having an undercut into contact with said portion of said cylindrical body extending above said upper surface of said lower die so that said undercut and said recess cooperate to form said brim.

3. The method as defined in claim 2, further comprising the step of precurling said portion of said cylindrical body extending above said upper surface of said lower die with a precurling iron prior to the lowering of said upper die.

4. The method as defined in claim 1, wherein said paper has a predetermined thickness, and a width of said brim is not less that five times said predetermined thickness.

5. The method as defined in claim 4, wherein a thickness of said brim is greater than said width of said brim.

6. The method as defined in claim 1, wherein a width of said brim is no greater than a product of the radius of curvature of the container at the brim and twice the uniaxial elongation of the paper material in the machine direction.

7. The method as defined in claim 1, wherein said container is a cup having a circular cross-section.

8. The method as defined in claim 1, wherein said container has an elliptical cross-section.

9. The method as defined in claim 1, wherein said container has an oblong cross-section.

10. The method as defined in claim 1, wherein said container has an oval cross-section.

11. A container formed of paper material comprising;

a substantially cylindrical body having an upper end and a lower end, a bottom integrally formed with said cylindrical body and closing said lower end, and a brim integrally formed on said upper end of said cylindrical body, wherein said paper material has a machine direction and a cross-machine direction, and said machine direction of said paper material is aligned with a circumferential direction of said container.

12. The container as defined in claim 11, wherein said paper material has a predetermined thickness, and a width of said brim is not less than five times said predetermined thickness.

13. The container as defined in claim 12, wherein a thickness of said brim is greater than said width of said brim.

14. The container as defined in claim 11, wherein a width of said brim is no greater than a product of the radius of curvature of the container at the brim and twice the uniaxial elongation of the paper material in the machine direction.

15. The container as defined in claim 11, wherein said container is a cup having a circular cross-section.

16. The container as defined in claim 11, wherein said container has an elliptical cross-section.

17. The container as defined in claim 11, wherein said container has an oblong cross-section.

18. The container as defined in claim 11, wherein said container has an oval cross-section.

* * * * *